United States Patent [19]

Green

[11] Patent Number: 4,766,626

[45] Date of Patent: Aug. 30, 1988

[54] SUPPORT PAD WORKING ON OR ABOUT VEHICLE TIRES

[76] Inventor: Philip A. Green, 653 E. Blithdale, Mill Valley, Calif. 94941

[21] Appl. No.: 105,812

[22] Filed: Oct. 8, 1987

[51] Int. Cl.[4] ..... A47G 9/06

[52] U.S. Cl. ..... 5/420; 428/81

[58] Field of Search ..... 5/417–420; 280/32.6; 428/81

[56] References Cited

U.S. PATENT DOCUMENTS

| | | | |
|---|---|---|---|
| 1,256,783 | 2/1918 | Fuller | 5/419 |
| 1,356,593 | 10/1920 | Bettiker . | |
| 1,372,846 | 3/1921 | Temple . | |
| 2,751,609 | 6/1956 | Oesterling, et al. . | |
| 2,853,399 | 9/1958 | Shoults . | |
| 3,222,695 | 12/1965 | Brown | 5/417 |
| 3,323,151 | 6/1967 | Lerman . | |
| 3,863,387 | 2/1975 | Webster et al. . | |
| 4,091,149 | 5/1978 | Oxendine | 428/81 |
| 4,658,452 | 4/1987 | Brockhaus . | |
| 4,671,393 | 6/1987 | Rainey . | |

FOREIGN PATENT DOCUMENTS

| | | | |
|---|---|---|---|
| 819449 | 10/1951 | Fed. Rep. of Germany | 5/417 |

*Primary Examiner*—Alexander Grosz

*Attorney, Agent, or Firm*—Thomas R. Lampe; Glen R. Grunewald

[57] ABSTRACT

A portable pad including a primary pad section and secondary pad sections defining an indentation for receiving a vehicle tire with the secondary pad sections adapted to be disposed on opposite sides of the tire.

2 Claims, 1 Drawing Sheet

SUPPORT PAD WORKING ON OR ABOUT VEHICLE TIRES

TECHNICAL FIELD

This invention relates to a portable pad employed as a protective support for a user thereof when the user performs work on or about the tire of a vehicle.

BACKGROUND ART

A number of mats or pads have been devised in the past for providing support and protection for a user. For example, U.S. Pat. Nos. 1,356,593; 1,372,846; 2,751,609; 2,853,399; 3,323,151; 3,863,387; 4,658,452; and 4,671,393 all disclose mats or pads of various types designed to be placed on the ground or other surfaces. The objective of these devices is generally to insulate and protect a user from moisture, heat or cold, or other uncomfortable and possibly harmful conditions.

Prior art arrangements such as those described in the above-identified patents are not satisfactory for providing protection and support for a user who performs work on or about a tire on a vehicle. Typical examples of such endeavors are the installation of snow chains, the removal of snow chains, and tire changing and repair.

The principal reason the prior art mats and pads are deficient in this regard is that the shapes thereof restrict their placement to only one side of a tire. A person working on or about a tire on a vehicle, however, often finds himself with a portion of his anatomy on more than one side of the tire at a given time. For example, the installation and removal of tire chains often requires that the person performing the job have his elbows, and perhaps other portions of his body as well, engage the ground or other supporting surface both under the vehicle and at a side of the vehicle at the same time. And, of course, tire chains are usually installed and removed under harsh conditions.

DISCLOSURE OF THE INVENTION

The present invention relates to a portable pad which is particularly adapted to be employed as a protective support for a user when performing work on or about a tire on a vehicle.

The pad includes a primary pad section and secondary pad sections connected to and projecting therefrom. The secondary pad sections are spaced from one another and define along with the primary pad section an indentation within the pad for receiving the tire. The secondary pad sections are adapted to be disposed on opposite sides of the tire when the tire is received within the indentation. Thus, the user is protected by the pad on more than just one side of the tire.

Other features, advantages, and objects of the present invention will become apparent with reference to the following detailed description and accompanying drawings in which:

BEST MODE FOR CARRYING OUT THE INVENTION

Figure 1:
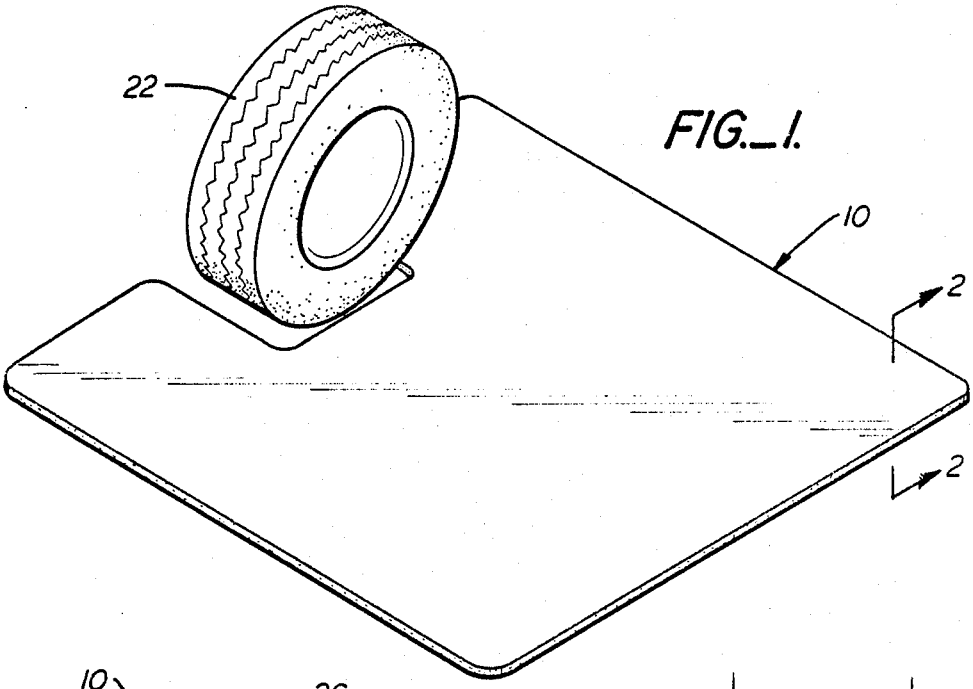
FIG. 1 is a perspective view illustrating a preferred form of pad constructed in accordance with the teachings of the present invention in place relative to a vehicle tire.

Referring now to the drawings, a pad constructed in accordance with the teachings of the present invention is designated generally by reference numeral 10. The pad includes a primary pad section 12 and secondary pad sections 14, 16 connected to and projecting from the primary pad section.

Secondary pad sections 14, 16 are spaced from one another and define along with primary pad section 12 an indentation 20. Indentation 20 is adapted to receive a tire 22 on a vehicle (not shown) with the secondary pad sections adapted to be disposed on opposite sides on the tire, as shown in FIG. 1, when the tire is received within the indentation.

Figure 2:
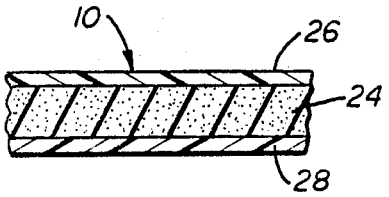
FIG. 2 is a partial sectional view taken along the line 2—2 in FIG. 1.

The primary and secondary pad sections are integral and, as is shown in FIG. 2, formed of an inner layer 24 of cellular material disposed or sandwiched between outer layers 26, 28 of substantially waterproof material, preferably plastic sheet material. Inner layer 24 may be formed of foamed, closed cell plastic or the like. The various layers are bonded together by means of either heat sealing or a suitable adhesive.

Primary pad section 12 is of generally rectangular configuration, as are indentation 20 and the secondary pad sections 14, 16. The corners of the primary and secondary pad sections are rounded as illustrated. Not only does this present a pleasing appearance but the rounded corners make it less likely that the pad will be hung up or impeded when placed into position.

As stated above, the secondary pad sections are adapted to be disposed on opposite sides of a vehicle tire. The pad may be positioned as shown in FIG. 1 with the secondary pad sections adjacent the front and rear sides of a tire, as shown, or the secondary pad sections may be disposed adjacent the inner and outer sides or walls of the tire. To provide this flexibility and to enable the pad to be utilized with the great majority of general purpose vehicle tire sizes, the distance X between secondary pad sections 14, 16 is preferably in the order of about fifteen inches and the dimension Y is preferably in the order of about twelve inches.

Figure 4:
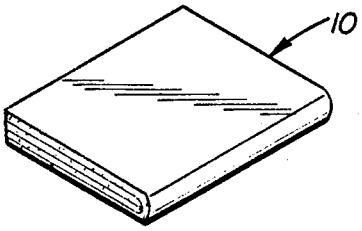
FIG. 4 shows the pad folded over on itself along the fold lines to provide a compact arrangement particularly suitable for carrying and storage.
Figure 3:
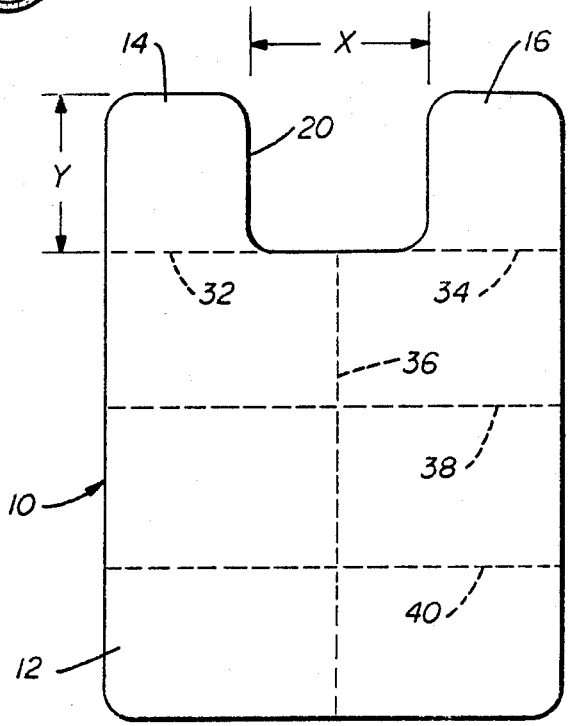
FIG. 3 is a plan view of the pad illustrating fold lines therein.

Pad 10 is preferably thin enough to enable the secondary pad sections to be folded along fold lines 32, 34 relative to the primary pad section whereby the secondary pad sections are lapped relative to the primary pad section. Additionally, the primary pad section 12 may be folded into sections along fold lines 36, 38, and 40 so that the pad, when not in use, may be folded into the compact configuration illustrated in FIG. 4.

What is claimed is:

1. A portable pad to be employed as a protective support for a user thereof when said user performs work on or about a tire on a vehicle, said pad being flexible and formed of an inner layer of closed cell, plastic foam disposed between outer layers of substantially waterproof, plastic sheet material, including a primary pad section of generally rectangular configuration and having rounded corners and secondary pad sections having rounded corners and integrally connected to and projecting from said primary pad section, said secondary pad sections being spaced from one another and defining along with said primary pad section an indentation having a generally rectangular configuration within said pad for receiving said tire, said secondary pad sections adapted to be disposed on opposite sides of said tire when said tire received within said indentation, said pad being adapted to be folded into a compact configuration along fold lines dividing said secondary pad sections from said primary pad section and additional fold lines formed in said primary pad section and intersecting to divide said primary pad section into a plurality of portions which are in at least partial registry with each other and with said secondary pad sections when said pad is in said compact configuration, both layers of said plastic sheet material being continuous and extending over said fold lines.

2. The portable pad of claim 1 wherein the secondary pad sections project from said primary pad section a distance of about twelve inches and wherein said secondary pad sections are spaced from one another a distance of about fifteen inches.

* * * * *

UNITED STATES PATENT AND TRADEMARK OFFICE

CERTIFICATE OF CORRECTION

PATENT NO. : 4,766,626

DATED : August 30, 1988

INVENTOR(S) : Philip A. Green

It is certified that error appears in the above-identified patent and that said Letters Patent are hereby corrected as shown below:

Column 3, line 5 insert --is-- after "tire".

Signed and Sealed this

Thirty-first Day of January, 1989

*Attest:*

DONALD J. QUIGG

*Attesting Officer*

*Commissioner of Patents and Trademarks*